US009563148B2

(12) United States Patent
Kanazawa et al.

(10) Patent No.: US 9,563,148 B2
(45) Date of Patent: Feb. 7, 2017

(54) IMAGE FORMING APPARATUS COMPRISING A PLURALITY OF ROTATABLE SHEET MEMBERS TO DETERMINE AMOUNT OF DEVELOPER BY CAPACITIVE MEANS

(71) Applicant: CANON KABUSHIKI KAISHA, Tokyo (JP)

(72) Inventors: Takayuki Kanazawa, Yokohama (JP); Takayuki Namiki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/935,293

(22) Filed: Nov. 6, 2015

(65) Prior Publication Data

US 2016/0131990 A1 May 12, 2016

(30) Foreign Application Priority Data

Nov. 11, 2014 (JP) ..... 2014-228935

(51) Int. Cl.
*G03G 15/08* (2006.01)

(52) U.S. Cl.
CPC ..... *G03G 15/086* (2013.01)

(58) Field of Classification Search
CPC . G03G 15/0825; G03G 15/025; G03G 15/086
USPC ..... 399/27
See application file for complete search history.

(56) References Cited

U.S. PATENT DOCUMENTS 8,971,734 B2 * 3/2015 Tsuchiya ..... G03G 15/0831 399/27
2003/0123888 A1 * 7/2003 Naito ..... G03G 15/086 399/27
2007/0206966 A1 * 9/2007 Komiya ..... G03G 15/0856 399/27
2014/0023385 A1 * 1/2014 Hosoya ..... G03G 15/086 399/27
2014/0037305 A1 * 2/2014 Monde ..... G03G 15/086 399/27
2014/0212166 A1 * 7/2014 Takeuchi ..... G03G 15/0898 399/106
2015/0086228 A1 * 3/2015 Noguchi ..... G03G 15/0889 399/27

FOREIGN PATENT DOCUMENTS

JP H08292634 A 11/1996
JP 2001242690 A 9/2001
JP 2007233103 A 9/2007

* cited by examiner

*Primary Examiner* — Billy Lactaoen
*Assistant Examiner* — Arlene Heredia Ocasio
(74) *Attorney, Agent, or Firm* — Canon U.S.A., Inc. IP Division

(57) ABSTRACT

An image forming apparatus includes a storage chamber configured to store developer, a plurality of sheet members disposed between a first electrode and a second electrode and disposed in the storage chamber, and a detecting portion configured to detect an output value relating to the capacitance between the first electrode and the second electrode. The amount of the developer is detected on the basis of the degree of deterioration of any one of the plurality of sheet members and the output value.

16 Claims, 11 Drawing Sheets

B
41
42
BULK DENSITY LOW
BULK DENSITY HIGH

B
41
42
BULK DENSITY HIGH
TONER SETTLES

B
51a
51b

CAPACITANCE DETECTION VALUE [pF]
15.6
15.4
15.2
15
14.8
14.6
14.4
AGITATION PERIOD
TIME [t]

PEAKS CORRESPONDING TO RESPECTIVE ONES OF SHEETS
CAPACITANCE DETECTION VALUE [pF]
15.6
15.4
15.2
15
14.8
14.6
14.4
AGITATION PERIOD
TIME [t]

IMAGE FORMING APPARATUS COMPRISING A PLURALITY OF ROTATABLE SHEET MEMBERS TO DETERMINE AMOUNT OF DEVELOPER BY CAPACITIVE MEANS

BACKGROUND OF THE INVENTION

Field of the Invention

The present invention relates to an image forming apparatus such as a multifunction apparatus.

An image forming apparatus forms an image on a recording medium using an electrophotographic image forming process. Examples of image forming apparatuses include an electrophotographic copying machine and an electrophotographic printer.

A developing unit means a unit that integrates developer, a developer storage portion, a developer bearing member, and the like disposed in an image forming apparatus and develops a developer image from an electrostatic image.

Description of the Related Art

Japanese Patent Laid-Open No. 2001-242690 discloses an image forming apparatus that detects abnormalities of a toner agitation unit on the basis of the range of fluctuation of the capacitance between a plurality of electrodes that periodically fluctuates owing to the rotation of the toner agitation unit.

Japanese Patent Laid-Open No. 2007-233103 discloses an image forming apparatus in which, in the process in which toner in a toner storage chamber decreases, a case where the range of fluctuation of capacitance changes from small to large and then to small is a case where the toner remaining amount is small, and that resets the reference value for calculating the remaining amount of toner when this phenomenon is detected.

Japanese Patent Laid-Open No. 8-292634 discloses a toner cartridge in which a sealing sheet sealing an opening between a toner storage chamber and a developing chamber is attached to an agitating member, and, after the sealing sheet is torn from the opening when a developing unit is used, the sealing sheet rotates together with the agitating member. It can be thought that, after that, this sealing sheet can also agitate developer as with the agitating sheet by rotating together with the agitating sheet.

In a situation in which there are such technologies, problems still remain in a configuration for detecting the remaining amount of developer by detecting capacitance. In the case of Japanese Patent Laid-Open No. 8-292634, the sealing sheet in the toner storage chamber attached to the main body of the apparatus may deteriorate under a severe usage environment such as an environment in which the image forming apparatus performs printing operation continuously for a long period under a high-temperature environment.

The Young's modulus of the sealing sheet (sheet member) decreases due to deterioration (the sealing sheet loses stiffness), and the sealing sheet plastically deforms so as to wrap itself around the agitating shaft (this deteriorated state will be hereinafter referred to as settling). In this case, the sealing sheet covers the agitating shaft and agitating member, and toner is less likely to enter the inside of the sealing sheet, and the bulk density of toner decreases accordingly. As a result, the capacitance of developer may be detected low compared to the actual toner amount.

SUMMARY OF THE INVENTION

The present invention provides an image forming apparatus the detection accuracy of the developer amount of which can be improved even if a sheet member is deteriorated.

In an aspect of the present invention, an image forming apparatus includes a storage chamber configured to store developer, a plurality of sheet members disposed between a first electrode and a second electrode and disposed in the storage chamber, and a detecting portion configured to detect an output value relating to the capacitance between the first electrode and the second electrode. The amount of the developer is detected on the basis of the degree of deterioration of any one of the plurality of sheet members and the output value.

Further features of the present invention will become apparent from the following description of exemplary embodiments with reference to the attached drawings.

DESCRIPTION OF THE EMBODIMENTS

Embodiments of the present invention will now be described illustratively in detail with reference to the drawings. However, the dimensions, materials, shapes, relative positions, and the like of components described in the embodiments are appropriately changed in accordance with the configuration of an apparatus to which the present invention is applied and various conditions. Therefore, they are not meant to limit the scope of the invention, unless particularly specified. In the description of the second and third embodiments, the same reference signs will be used to designate the same components as those in the first embodiment, so that the description thereof will be omitted.

First Embodiment

Figure 1:
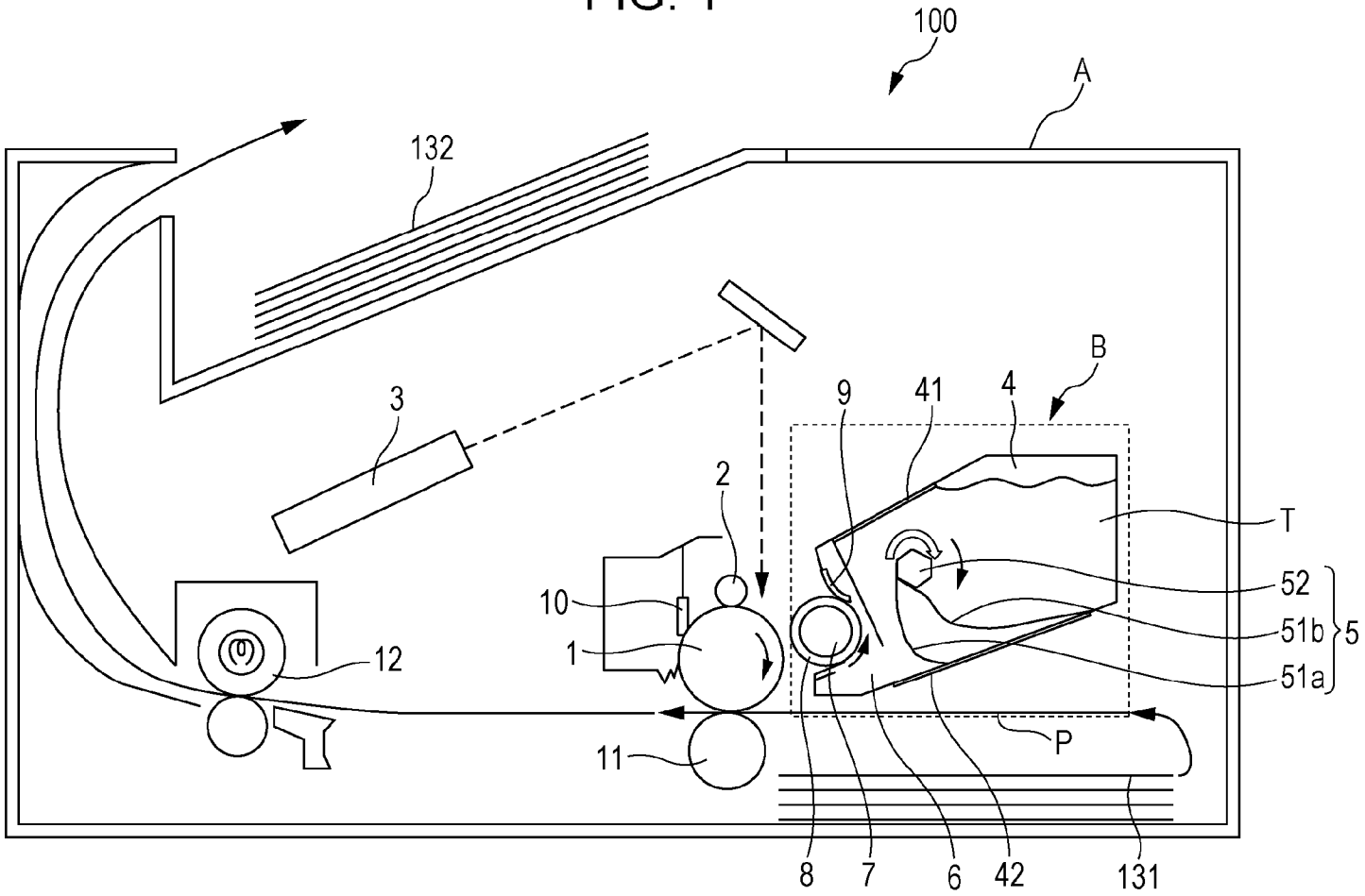
FIG. 1 is a sectional view of an image forming apparatus.

FIG. 1 is a sectional view of an image forming apparatus 100. As shown in FIG. 1, the image forming apparatus 100 includes a main body A of the apparatus and a cartridge B mounted to the main body A of the apparatus. A sheet P of paper or the like is conveyed from a sheet cassette 131 of the main body A of the apparatus by a conveyance roller (not shown). In synchronization with this sheet conveyance, a photosensitive drum 1 is charged by a charging roller 2 serving as a charging unit, and then selective exposure is performed by an exposure unit 3 to form an electrostatic image.

Magnetic one-component developer T (hereinafter referred to as toner) is supplied from a storage chamber 4 by an agitating sheet 51*a* of a rotary member 5 to a developing chamber 6 and is borne on the surface of a hollow developing sleeve 8 (hereinafter referred to as developing sleeve) in which a magnet roller 7 serving as a conveying member is disposed. A developing blade 9 forms a thin layer of desired amount of toner on the surface of the developing sleeve 8. After the completion of transfer, the photosensitive drum 1 is cleaned by a cleaning blade 10 having elasticity.

Next, by applying a developing bias to the developing sleeve 8, developer is supplied according to the electrostatic image, and a developer image is developed on the photosensitive drum 1. This image is transferred to the synchronized sheet P by the application of a bias voltage to a transfer roller 11. The sheet P is conveyed to a fixing unit 12, in which the image is fixed, and is discharged by a discharge roller (not shown) to a discharge portion 132 in the upper part of the apparatus.

The rotary member 5 has a configuration in which one end of the agitating sheet 51*a* having flexibility is attached to a rotating shaft 52 that is rotatably disposed in the longitudinal direction of the storage chamber 4. The rotary member 5 operates with the printing operation. The operations thereof include conveying an appropriate amount of toner from the storage chamber 4 to the developing chamber 6 by the rotation of the agitating sheet 51*a*, and the stabilization of the toner bulk density in the storage chamber 4.

For the bulk density of toner, in a state where the image forming apparatus has been out of use for a while (for example, after a lapse of several hours after turning off), toner settles, and appropriate circulation and detection result of capacitance may not be obtained. For example, a flexible material such as polyethylene terephthalate (PET) having a thickness of about several hundred μm is used as a material for the agitating sheet 51*a*. A flexible material such as polycarbonate (PC) or polyphenylene sulfide (PPS) may also be used.

Figure 2A:
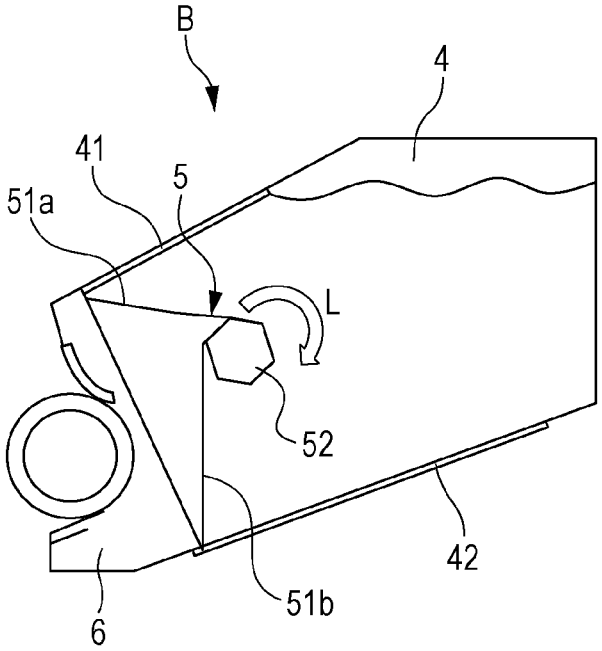
FIGS. 2A and 2B include a sectional view of a storage chamber before a sealing sheet is opened.

FIG. 2A is a sectional view of the storage chamber 4 before a sealing sheet 51*b* is opened. When the cartridge B is new, the storage chamber 4 storing developer and the developing chamber 6 are separated from each other by the sealing sheet 51*b*. By doing so, when the cartridge B is new, parts in the cartridge B are kept in a clean state without adhesion of toner thereto, and toner leakage during transportation is prevented.

Figure 2B:
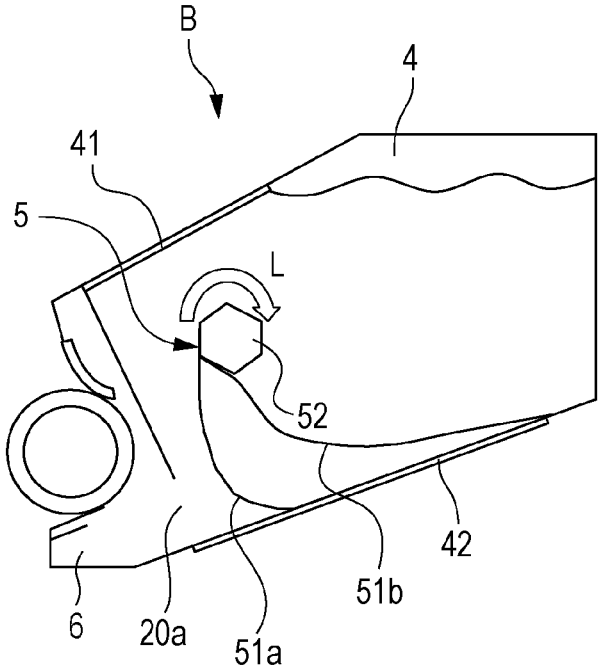

FIG. 2B is a sectional view of the cartridge B after the sealing sheet 51*b* is opened. The agitating sheet 51*a* and sealing sheet 51*b* as "sheet members" are disposed in the storage chamber 4. In other words, the rotary member 5 includes the rotating shaft 52, the agitating sheet 51*a* (sheet) as "an agitating member" attached to the rotating shaft 52, and the sealing sheet 51*b* (sheet) as "a sealing member." The agitating sheet 51*a* is a sheet for agitating the developer. The sealing sheet 51*b* is a member that is lower in stiffness than the agitating sheet 51*a*, and seals an opening 20*a* of the storage chamber 4 so that the developer does not leak out.

When the cartridge B starts to be used, the rotating shaft 52 is rotated, and the sealing sheet 51*b* is wound on the rotating shaft 52 while rotating in the detachment direction L and is thereby opened. The sealing sheet 51*b* is removed, and the toner in the storage chamber 4 is conveyed to the developing chamber 6. After the opening 20*a* is opened, the sealing sheet 51*b* rotates together with the agitating sheet 51*a* and agitates the developer in the storage chamber 4 so as to assist the agitating sheet 51*a*.

In this embodiment, to make the configuration inexpensive, the rotating shaft 52 functions to wind the sealing sheet 51*b* as well as to rotate the agitating sheet 51*a*. By doing so, there is no need to separately provide a winding shaft for winding the sealing sheet 51*b*. In a state where the cartridge B is new, the phases of the agitating sheet 51*a* and the sealing sheet 51*b* are set so as to differ by 60°.

This is caused by the fact that in FIG. 2A, the angle formed by the agitating sheet 51*a* stretched taut along an attachment surface on the surface of the rotating shaft 52 and the sealing sheet 51*b* stretched taut along an attachment surface on the surface of the rotating shaft 52 is 60° (see FIG. 2A). This is caused by the fact that the rotating shaft 52 is hexagonal in cross-section. The cross-sectional shape of the rotating shaft 52 is not limited to a hexagonal shape. As with the agitating sheet 51*a*, the sealing sheet 51*b* is formed of a flexible material, and one end thereof is attached to the rotating shaft 52.

For example, a flexible material such as polyethylene terephthalate (PET) having a thickness of about several tens μm is used as a material for the sealing sheet 51*b*. A flexible material such as polycarbonate (PC) or polyphenylene sulfide (PPS) may also be used. By forming the sealing sheet 51*b* of a material thinner than that of the agitating sheet 51*a*, the cost can be reduced.

A description will be given of a configuration for detecting the amount of the developer in the cartridge B (developer remaining amount) in the state of FIG. 2B. An electrode 41 is attached to the ceiling of the storage chamber 4, and an electrode 42 is attached to the floor of the storage chamber 4. The electrodes 41 and 42 are used to detect capacitance. The electrodes 41 and 42 are formed of metal plate, are disposed opposite each other, and extend in the longitudinal direction of the cartridge B.

The capacitance C between the electrodes 41 and 42 is given by $C=K\epsilon\times A/d$, where A is the area of the electrodes 41 and 42, d is the distance between the electrodes 41 and 42, and $K\epsilon$ is the relative permittivity between the electrodes 41 and 42. The relative permittivity $K\epsilon$ is a value that changes depending on the amount of the toner between the electrodes 41 and 42. When the proportion of the toner between the electrodes 41 and 42 is large, the $K\epsilon$ is high. When the proportion of the toner between the electrodes 41 and 42 is small, the $K\epsilon$ is low. Therefore, a correlation is made between the toner amount (toner remaining amount) and the capacitance.

In order to stabilize the bulk density of toner during long-term disuse and to detect the capacitance, the agitating sheet 51*a* and the sealing sheet 51*b* are disposed between the electrode 41 as "a first electrode" and the electrode 42 as "a second electrode."

Figure 3:
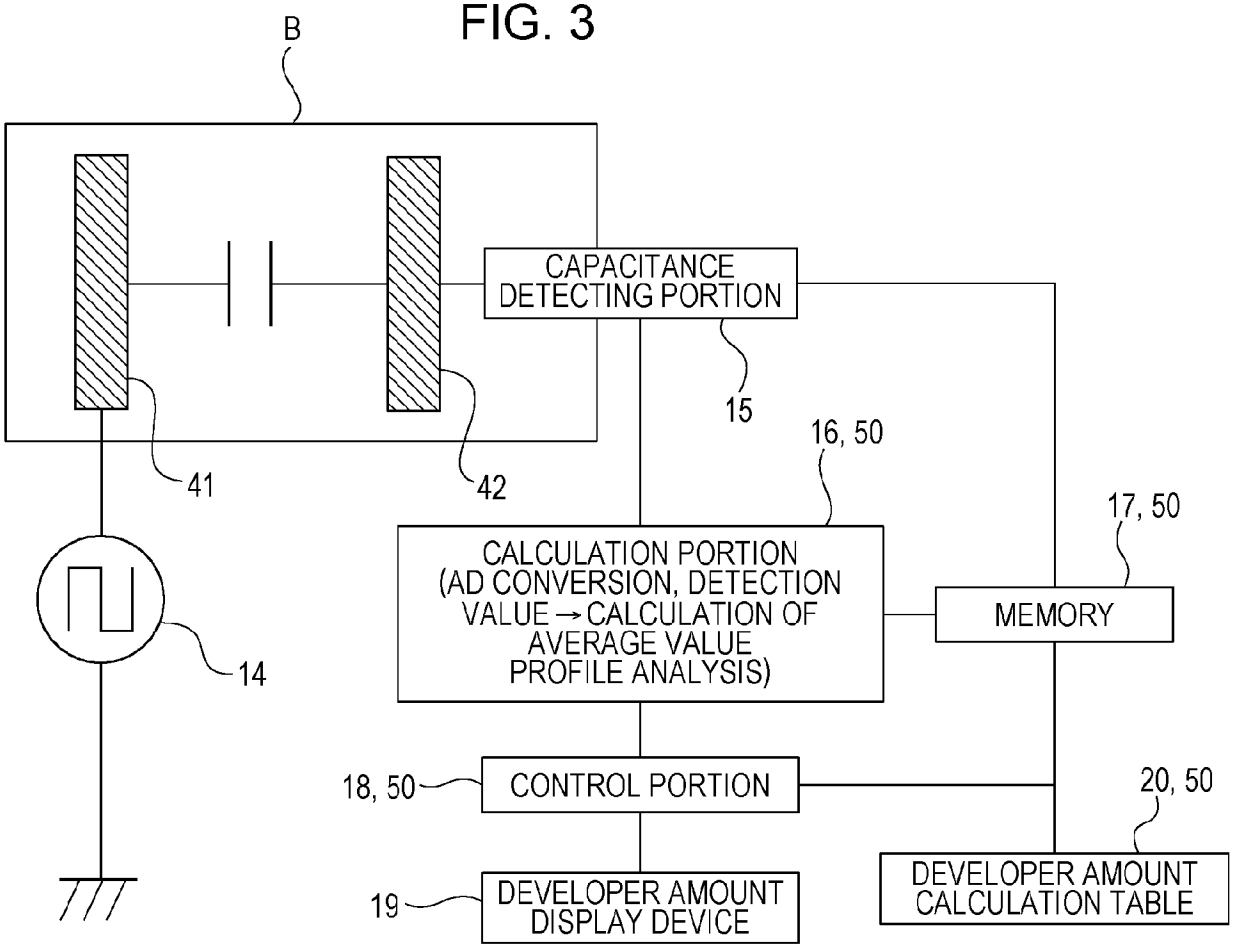
FIG. 3 is a configuration diagram showing a toner amount detecting circuit when a cartridge is mounted to the main body A of the apparatus.

FIG. 3 is a configuration diagram showing a toner amount detecting circuit when the cartridge B is mounted to the main body A of the apparatus. An electric contact (not shown) is provided between the main body A of the apparatus and the cartridge B. When the cartridge B is mounted to the main body A of the apparatus, the electrodes 41 and 42 (formed of metal plate) of the cartridge B are electrically connected to a capacitance detecting portion 15 in the main body A of the apparatus through the above electric contact. The capacitance detecting portion 15 as "a detecting portion" detects an output value relating to the capacitance between the first electrode 41 and the second electrode 42. The capacitance detecting portion 15 is part of a board of a controller 50, is a semiconductor, measures a current flowing between the electrodes 41 and 42, and detects the capacitance between both electrodes from the current and voltage.

A developer amount detecting bias in which DC and AC components are superimposed is applied to the electrode 41 (first electrode) from a power supply 14. At that time, a charge is induced in the electrode 42 (second electrode). By detecting the current flowing to the capacitance detecting portion 15, the capacitance between the electrodes 41 and 42 can be measured.

A calculation portion 16, a control portion 18, and a developer amount display device 19 are connected sequentially to the capacitance detecting portion 15. A memory 17 and a developer amount calculation table 20 are connected sequentially to the capacitance detecting portion 15. The calculation portion 16 and the memory 17 are connected to each other, and the control portion 18 is connected to the middle of a line connecting the memory 17 and the developer amount calculation table 20. The memory 17 has information on the relationship between the output value of capacitance and the amount of developer at each degree of deterioration of the sealing sheet 51*b*, the relationship having characteristics such that at any amount of developer, the output value of the capacitance detecting portion 15 decreases with the deterioration of the sealing sheet 51*b* (to be described in detail later). The calculation portion 16 detects the amount of developer on the basis of the information of the memory 17 and the output value of the capacitance detecting portion 15.

In the calculation portion 16, capacitance $C=Ie/(2\pi fVe)$ is calculated on the basis of the effective value of applied voltage Ve detected in the capacitance detecting portion 15, the effective value of applied current Ie, and frequency f. This value is referred to as "capacitance detection value," and is used to calculate the predicted amount of the toner in the cartridge B. In the following description, for the sake of convenience, the above-described calculation portion 16, memory 17, developer amount calculation table 20, and control portion 18 may be collectively referred to as the controllers 50.

Figures 4A, 4B, 4C, 4D, 4E:
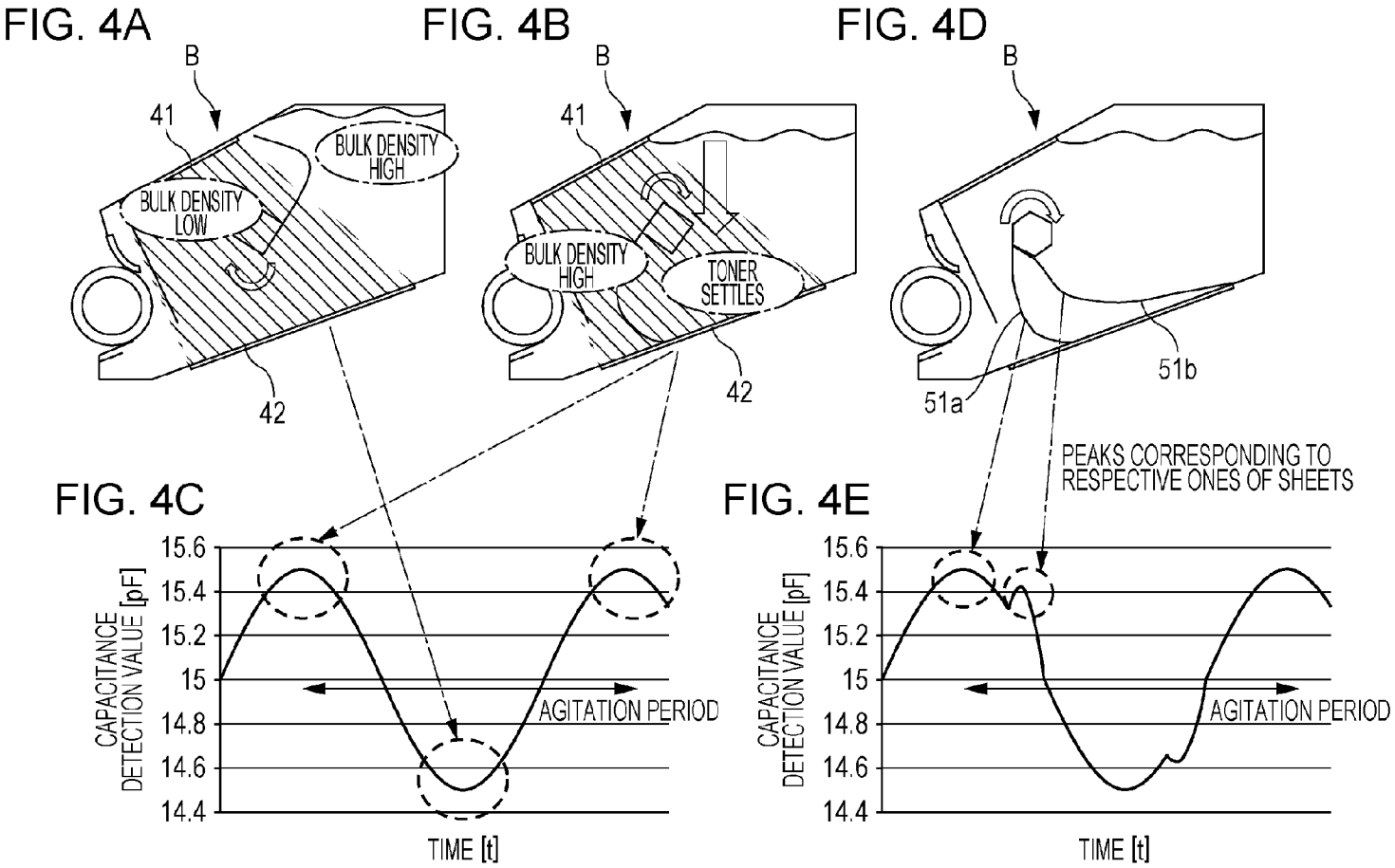
FIGS. 4A to 4E include sectional views of a cartridge having a system in which a rotary member 5 has one sheet, an agitating sheet or a sealing sheet.

Calculation of capacitance average value FIG. 4D is a sectional view of the cartridge B during the detection of capacitance. FIG. 4E is a graph showing the capacitance detection value at the time of FIG. 4D. FIG. 4E shows that the capacitance detection value increases and decreases with a constant period. The reason is that the bulk density of the toner between the electrodes 41 and 42 changes with the movement of the agitating sheet 51*a*.

For the sake of simplicity, a system having one sheet will be described. FIGS. 4A and 4B are sectional views of a cartridge B having a system in which a rotary member 5 has one sheet, agitating sheet 51*a* or sealing sheet 51*b*. As shown in FIG. 4A, when the rotary member 5 has lifted toner, the bulk density of the toner in an area that contributes to capacitance (shaded area) is low, and the capacitance is small.

In contrast, as shown in FIG. 4B, when the rotary member 5 is lifting toner, the toner outside the area that contributes to capacitance (shaded area) settles, and toner is pushed into the area that contributes to capacitance (shaded area) by the rotary member 5. Therefore, the bulk density of toner is high, and the capacitance is large. As described above, the capacitance fluctuates with the agitation period.

In the case of a system having one sheet, as shown in FIG. 4C, the capacitance detection value has peaks corresponding to the phases of the agitating sheet. In the case of a system having two sheets, as shown in FIG. 4E, the capacitance detection value has peaks corresponding to respective ones of the agitating sheet 51*a* and the sealing sheet 51*b*.

If the capacitance detection value of FIG. 4E is used as it is, the variation in agitation period is accounted for. So, in order to further improve the accuracy, in this embodiment, detection values obtained in the rotation period (3 seconds) of the rotary member 5 are averaged. In other words, sampling of the capacitance detection value is performed every 10 msec, and it is repeated for three seconds. By averaging 300 detection values obtained, the average value (hereinafter referred to as "the capacitance average value" is obtained.

Figure 5A:
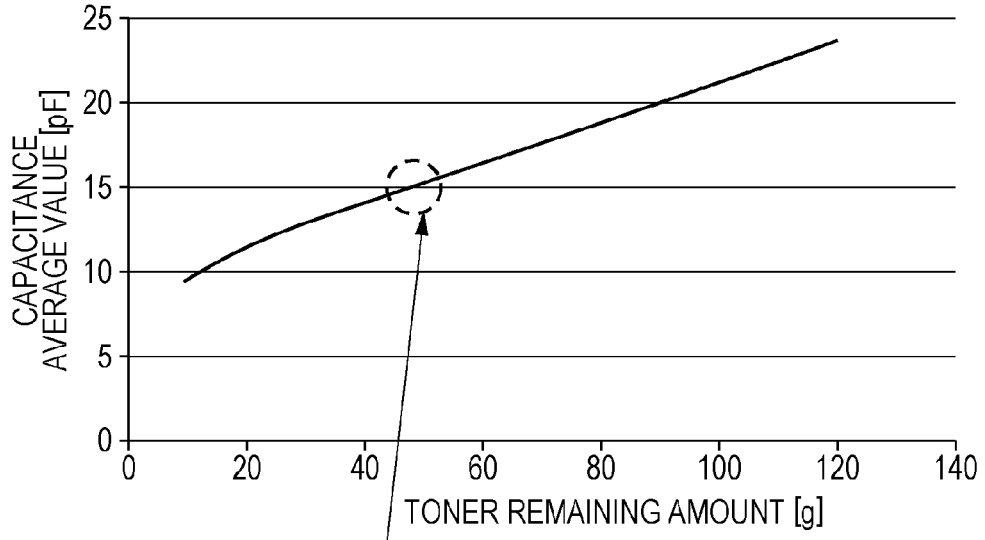
FIGS. 5A and 5B include a graph showing the relationship between the capacitance average value and the toner amount.

FIG. 5A is a graph showing the relationship between the capacitance average value [pF] and the toner amount [g]. Here, by using the output average value referred to as the capacitance average value, and by correlating it with the toner amount, the capacitance average value can be correlated stably with the toner amount.

Figure 5B:
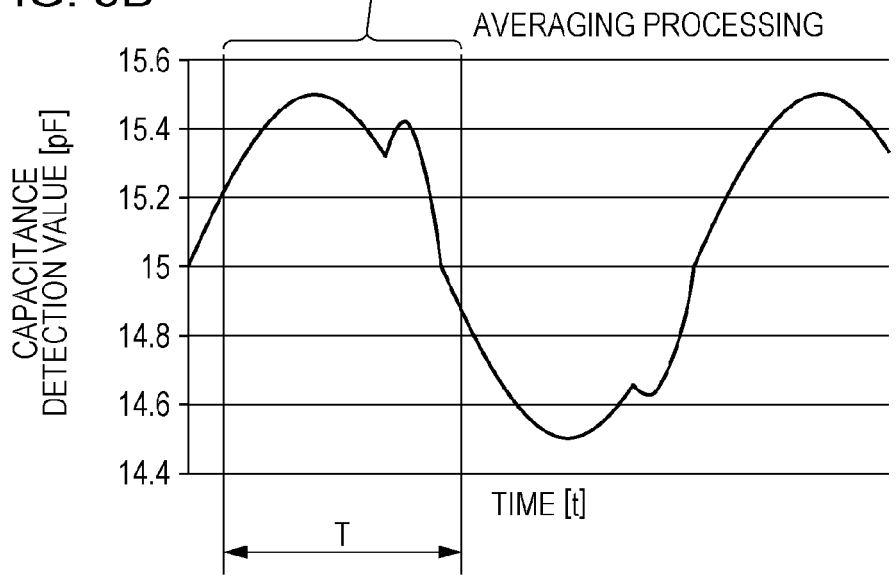

FIG. 5B is a graph showing the relationship between the capacitance detection value [pF] and the time [t]. The capacitance detection value changes with the period with which the rotary member 5 rotates. This capacitance the capacitance detection value of which changes with a predetermined period was detected, it was averaged, and 15 pF was obtained as a capacitance average value here. The toner amount at this time was 50 g. A plot of such data is shown in FIG. 5A.

The control portion 18 calculates the toner amount on the basis of a table showing the relationship between the capacitance average value and the toner amount as in FIG. 5A, and displays the calculated toner amount on the developer amount display device 19 of the main body A of the apparatus. Here, further fine control is performed as described below.

Next, the configuration taking into account the deterioration of the sealing sheet 51*b* will be described. In recent years, printers have been required to have a long life and high durability. However, by performing printing operation under a sever usage environment, for example, by performing printing operation continuously for a long period under high temperature, the sealing sheet 51*b*, which is thin compared to the agitating sheet 51*a*, may deteriorate.

Figure 6A:
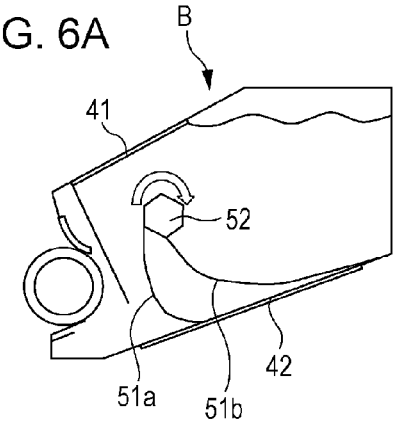
FIGS. 6A to 6D include sectional views showing the change of the cartridge with the deterioration of the sealing sheet.
Figure 6B:
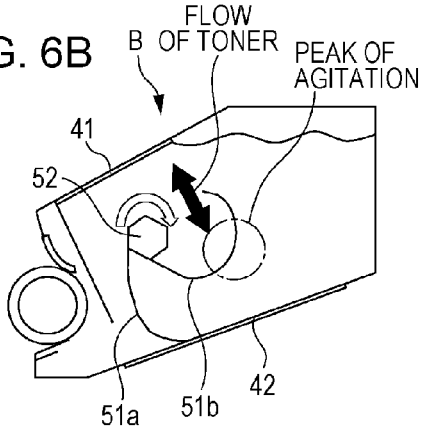
Figure 6C:
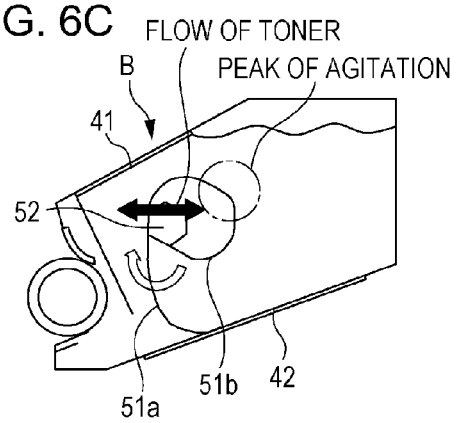
Figure 6D:
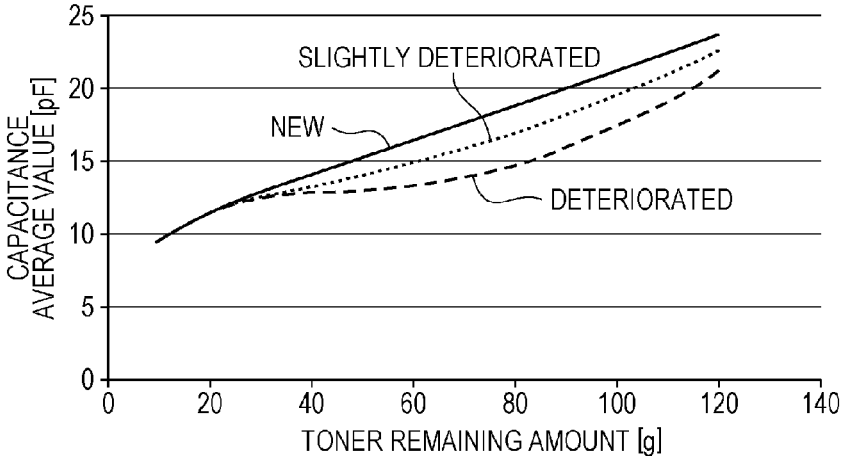

FIGS. 6A to 6C are sectional views showing the change of the cartridge B with the deterioration of the sealing sheet 51*b*. FIG. 6A shows a new state, FIG. 6B shows a slightly deteriorated state, and FIG. 6C shows a deteriorated state. FIG. 6D is a graph showing relationships between the capacitance average value and the toner amount corresponding to the states of FIGS. 6A to 6C. As in FIGS. 6A, 6B, and 6C, as the sealing sheet 51*b* deteriorates, the Young's modulus of the sealing sheet 51*b* decreases, and the sealing sheet 51*b* plastically deforms so as to wrap itself around the rotating shaft 52.

In such a case, as in FIGS. 6B and 6C, the sealing sheet 51*b* deforms so as to cover the circumference of the rotating shaft 52. As the sealing sheet 51*b* deteriorates, the flow of toner is blocked as shown by the black arrow, and toner is less likely to enter the inside of the sealing sheet 51*b* as shown in FIG. 6C. Accordingly, the bulk density of the toner between the electrodes 41 and 42 decreases. As a result, as in FIG. 6D, as the sealing sheet 51*b* deteriorates, the capacitance is detected low compared to the actual toner amount.

Figure 7:
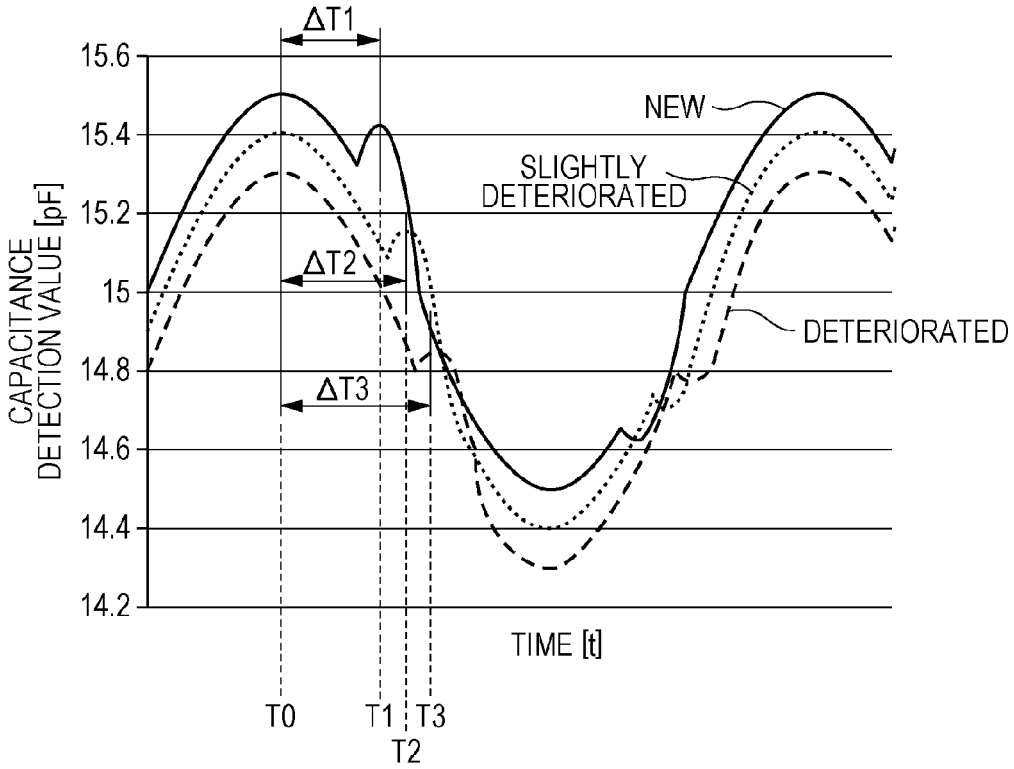
FIG. 7 shows graphs showing relationships between the capacitance detection value and the time in respective cases where the sealing sheet is new, slightly deteriorated, and deteriorated.

FIG. 7 shows graphs showing relationships between the capacitance detection value and the time in respective cases where the sealing sheet 51*b* is new, slightly deteriorated, and deteriorated. For the above reason, here, it is attempted to predict the state of deterioration (settling) of the sealing sheet 51*b* by analyzing the profile of the capacitance detection value and to select the correspondence between the capacitance output value and the toner amount. The profile of the capacitance detection value changes with the deterioration of the sealing sheet 51*b*.

When the sealing sheet 51*b* is new, the agitating sheet 51*a* and the sealing sheet 51*b* differ in the phase of attachment position, and the sealing sheet 51*b* pushes up the toner 60° after the agitating sheet 51*a* pushes up the toner. Reflecting this, the capacitance profile when the sealing sheet 51*b* is new has two peaks at a position corresponding to 0° and a position corresponding to 60°. Here, the peak of 0° corresponds to the peak of the agitating sheet 51*a*, and the peak of 60° corresponds to the peak of the sealing sheet 51*b*.

The graph when the sealing sheet 51*b* is new will be analyzed. Time T0 (assume that this time is 0 msec) is the peak of capacitance detection value due to the rotation of the agitating sheet 51*a*. Time T1 (assume that this time is 500 msec) is the peak of capacitance detection value due to the rotation of the sealing sheet 51*b*. Therefore, the phase time difference of capacitance detection value when the sealing sheet 51*b* is new is ΔT1 (this time is 500 msec).

When the sealing sheet 51*b* is slightly deteriorated, the peak of 60° corresponding to the peak of the sealing sheet 51*b* shifts to the position of 90°. In other words, the peak time of the sealing sheet 51*b*, which is T1 (assume that this time is 500 msec) when the sealing sheet 51*b* is new, is T2 (assume that this time is 750 msec) when the sealing sheet 51*b* is slightly deteriorated. Thereby, the phase time difference between the agitating sheet 51*a* and the sealing sheet 51*b* changes from ΔT1 (this time is 500 msec) to ΔT2 (this time is 750 msec). In this state, since the sealing sheet 51*b* curls, the peak point of pushing up shifts as shown in the circled part of FIG. 6B, and the sealing sheet 51*b* pushes up toner later than when the sealing sheet 51*b* is new.

When the sealing sheet 51*b* is further deteriorated, the peak of 60° corresponding to the peak of the sealing sheet 51*b* shifts to the position of about 120°. In other words, the peak time of the sealing sheet 51*b*, which is T1 (assume that this time is 500 msec) when the sealing sheet 51*b* is new, is T3 (assume that this time is 1000 msec) when the sealing sheet 51*b* is deteriorated. Thereby, the phase time difference between the agitating sheet 51*a* and the sealing sheet 51*b* changes from ΔT1 (this time is 500 msec) to ΔT3 (this time is 1000 msec). As described above, the phase time difference ΔT between both local maximum values increases with the deterioration of the sealing sheet 51*b*, and the state of deterioration can be estimated from the phase time difference ΔT.

The reason that when time T0=0 msec, time T1=500 msec, time T2=750 msec, and time T3=1000 msec comes from the following calculation. The sine waves of FIG. 7 have a period of three seconds, that is, 3000 msec. When the phase difference is 60°, 3000 msec×60°/360°=500 msec. When the phase difference is 90°, 3000 msec×90°/360°=750 msec. When the phase difference is 120°, 3000 msec×120°/360°=1000 msec.

$$\Delta T1 = T1 - T0 = 500 \text{ msec}, \ \Delta T2 = T2 - T0 = 750 \text{ msec, and } \Delta T3 = T3 - T0 = 1000 \text{ msec.}$$

In preparation for starting the sequence, a plurality of correspondence tables between the output average value and the toner amount corresponding to FIG. 6D are prepared as Table 1. The calculation portion 16 of FIG. 3 is prepared to calculate ΔT from the profile of the capacitance detection value. Thresholds are set for the value of ΔT.

In the case of this embodiment, a threshold when the sealing sheet 51*b* moves from a new state to a slightly deteriorated state in the graphs of FIG. 7 is referred to as a first threshold t1 and is set to 575 msec. This is a numerical value midway between time T1 and time T2. A threshold when the sealing sheet 51*b* moves from a slightly deteriorated state to a deteriorated state in the graphs of FIG. 7 is referred to as a second threshold t2 and is set to 875 msec. This is a numerical value midway between time T2 and time T3.

The information on the relationship between the output value of capacitance and the developer amount at each degree of deterioration of the sealing sheet 51*b* is a profile showing a relationship in which when the developer amount is the same, the output value of capacitance detected by the capacitance detecting portion 15 decreases with the deterioration of the sealing sheet 51*b* (Table 1). The pieces of information at respective degrees of deterioration (Tables 1-1 to 1-3) are correlated with a plurality of graphs that differ in the output value of capacitance with respect to the time (the graphs of "New," "Slightly deteriorated," and "Deteriorated" in FIG. 7). The capacitance detecting portion 15 detects that when the sealing sheet 51*b* wraps itself around the rotating shaft 52, the output value changes.

The degree of deterioration of the sealing sheet 51*b* is the degree to which the sealing sheet 51*b* is deteriorated, and corresponds to a degree that increases as the phase time difference ΔT between the agitating sheet 51*a* and the sealing sheet 51*b* increases. As described above, it can be said that the degree of deterioration of the sealing sheet 51*b* when the sealing sheet 51*b* is new (phase time difference ΔT1)<when the sealing sheet 51*b* is slightly deteriorated (phase time difference ΔT2)<when the sealing sheet 51*b* is deteriorated (phase time difference ΔT3). Phase time means the time at a predetermined phase.

The controllers 50 perform the following on the basis of data on the output value of capacitance of a waveform having a rotation period of the agitating sheet 51*a* and the sealing sheet 51*b* as "respective ones of a plurality of sheet members" calculated by the calculation portion 16 (phase time difference between local maximum values of output values). The controller 50 (control portion 18) selects, on the basis of such a phase time difference, one of the pieces of information (one of Table 1-1, Table 1-2, and Table 1-3) correlated with one of the phase time differences of the graphs (one of ΔT1, ΔT2, and ΔT3). Here, the degree of deterioration of the sealing sheet 51*b*, which is one of the above "plurality of sheet members," is recognized.

The controller 50 (control portion 18) selects one of the pieces of information (one of Table 1-1, Table 1-2, and Table 1-3) correlated with one of the phase time differences (one of ΔT1, ΔT2, and ΔT3) such that the larger the phase time difference, the larger the developer amount with respect to the output value of capacitance of the selected piece of information. As is obvious from Table 1, when the developer amount is 48 g, 15.01 pF in Table 1-1 of "New," 13.83 pF in Table 1-2 of "Slightly deteriorated," and 12.92 pF in Table 1-3 of "Deteriorated." This shows that as the developer amount with respect to the capacitance average value (output value of capacitance) increases, Table 1-1 is used, then Table 1-2 is used, and then Table 1-3 is used.

The controller 50 (control portion 18) calculates the average value of output value of capacitance, and derives, on the basis of the average value of output value, the developer amount corresponding to the output value of the selected piece of information.

For example, in FIG. 7, when the sealing sheet 51*b* is new, the average value of output value of capacitance is 15 pF. Here, referring to Table 1-1 (New), the remaining amount of developer when the average value of capacitance is 15.01 pF is 48 g. Therefore, it is detected that 48 g of developer exists in the storage chamber 4.

In FIG. 7, when the sealing sheet 51*b* is slightly deteriorated, the average value of output value of capacitance is 14.90 pF. Here, referring to Table 1-2 (Slightly deteriorated), the remaining amount of developer when the average value of capacitance is 14.89 pF is 60 g. Therefore, it is detected that 60 g of developer exists in the storage chamber 4.

In FIG. 7, when the sealing sheet 51*b* is deteriorated, the average value of output value of capacitance is 14.80 pF. Here, referring to Table 1-3 (Deteriorated), the remaining amount of developer when the average value of capacitance is 14.88 pF is 80 g. Therefore, it is detected that 80 g of developer exists in the storage chamber 4.

TABLE 1

| Table 1-1 (New) | | Table 1-2 (Slightly deteriorated) | | Table 1-3 (Deteriorated) | |
|---|---|---|---|---|---|
| Capacitance average value [pF] | Remaining amount [g] | Capacitance average value [pF] | Remaining amount [g] | Capacitance average value [pF] | Remaining amount [g] |
| 9.57 | 10 | 9.57 | 10 | 9.57 | 10 |
| 9.98 | 12 | 9.98 | 12 | 9.98 | 12 |
| 10.37 | 14 | 10.37 | 14 | 10.37 | 14 |
| 10.75 | 16 | 10.75 | 16 | 10.75 | 16 |
| 11.12 | 18 | 11.12 | 18 | 11.12 | 18 |
| 11.48 | 20 | 11.48 | 20 | 11.48 | 20 |
| 11.82 | 22 | 11.78 | 22 | 11.78 | 22 |
| 12.12 | 24 | 12.03 | 24 | 12.03 | 24 |
| 12.37 | 26 | 12.23 | 26 | 12.23 | 26 |
| 12.61 | 28 | 12.38 | 28 | 12.38 | 28 |
| 12.85 | 30 | 12.49 | 30 | 12.49 | 30 |
| 13.09 | 32 | 12.60 | 32 | 12.57 | 32 |
| 13.33 | 34 | 12.75 | 34 | 12.64 | 34 |
| 13.45 | 35 | 12.82 | 35 | 12.67 | 35 |
| 13.57 | 36 | 12.89 | 36 | 12.70 | 36 |
| 13.69 | 37 | 12.97 | 37 | 12.73 | 37 |
| 13.81 | 38 | 13.04 | 38 | 12.76 | 38 |
| 13.93 | 39 | 13.12 | 39 | 12.78 | 39 |
| 14.05 | 40 | 13.19 | 40 | 12.80 | 40 |
| 14.29 | 42 | 13.35 | 42 | 12.83 | 42 |
| 14.53 | 44 | 13.51 | 44 | 12.85 | 44 |
| 14.77 | 46 | 13.67 | 46 | 12.88 | 46 |
| 15.01 | 48 | 13.83 | 48 | 12.92 | 48 |
| 15.25 | 50 | 14.00 | 50 | 12.97 | 50 |
| 15.49 | 52 | 14.17 | 52 | 13.02 | 52 |
| 15.73 | 54 | 14.34 | 54 | 13.09 | 54 |
| 15.97 | 56 | 14.52 | 56 | 13.17 | 56 |
| 16.21 | 58 | 14.70 | 58 | 13.26 | 58 |
| 16.45 | 60 | 14.89 | 60 | 13.35 | 60 |
| 16.69 | 62 | 15.08 | 62 | 13.46 | 62 |
| 16.93 | 64 | 15.27 | 64 | 13.58 | 64 |

TABLE 1-continued

| Table 1-1 (New) | | Table 1-2 (Slightly deteriorated) | | Table 1-3 (Deteriorated) | |
|---|---|---|---|---|---|
| Capacitance average value [pF] | Remaining amount [g] | Capacitance average value [pF] | Remaining amount [g] | Capacitance average value [pF] | Remaining amount [g] |
| 17.17 | 66 | 15.47 | 66 | 13.71 | 66 |
| 17.41 | 68 | 15.67 | 68 | 13.84 | 68 |
| 17.65 | 70 | 15.87 | 70 | 13.99 | 70 |
| 17.89 | 72 | 16.08 | 72 | 14.15 | 72 |
| 18.13 | 74 | 16.29 | 74 | 14.32 | 74 |
| 18.37 | 76 | 16.51 | 76 | 14.49 | 76 |
| 18.61 | 78 | 16.73 | 78 | 14.68 | 78 |
| 18.85 | 80 | 16.96 | 80 | 14.88 | 80 |
| 19.09 | 82 | 17.19 | 82 | 15.09 | 82 |
| 19.33 | 84 | 17.43 | 84 | 15.30 | 84 |
| 19.57 | 86 | 17.67 | 86 | 15.53 | 86 |
| 19.81 | 88 | 17.91 | 88 | 15.77 | 88 |
| 20.05 | 90 | 18.16 | 90 | 16.02 | 90 |
| 20.29 | 92 | 18.41 | 92 | 16.27 | 92 |
| 20.53 | 94 | 18.67 | 94 | 16.54 | 94 |
| 20.77 | 96 | 18.94 | 96 | 16.82 | 96 |
| 21.01 | 98 | 19.21 | 98 | 17.11 | 98 |
| 21.25 | 100 | 19.49 | 100 | 17.40 | 100 |
| 21.49 | 102 | 19.77 | 102 | 17.71 | 102 |
| 21.73 | 104 | 20.05 | 104 | 18.03 | 104 |
| 21.85 | 105 | 20.20 | 105 | 18.19 | 105 |
| 21.97 | 106 | 20.35 | 106 | 18.36 | 106 |
| 22.09 | 107 | 20.50 | 107 | 18.52 | 107 |
| 22.21 | 108 | 20.65 | 108 | 18.69 | 108 |
| 22.33 | 109 | 20.80 | 109 | 18.87 | 109 |
| 22.45 | 110 | 20.95 | 110 | 19.04 | 110 |
| 22.57 | 111 | 21.10 | 111 | 19.22 | 111 |
| 22.69 | 112 | 21.26 | 112 | 19.40 | 112 |
| 22.81 | 113 | 21.42 | 113 | 19.58 | 113 |
| 22.93 | 114 | 21.58 | 114 | 19.77 | 114 |
| 23.05 | 115 | 21.74 | 115 | 19.95 | 115 |
| 23.17 | 116 | 21.90 | 116 | 20.14 | 116 |
| 23.29 | 117 | 22.07 | 117 | 20.34 | 117 |
| 23.41 | 118 | 22.23 | 118 | 20.53 | 118 |
| 23.53 | 119 | 22.40 | 119 | 20.73 | 119 |
| 23.65 | 120 | 22.57 | 120 | 20.93 | 120 |
| 22.69 | 122 | 21.26 | 122 | 19.40 | 122 |
| 22.93 | 124 | 21.58 | 124 | 19.77 | 124 |
| 23.17 | 126 | 21.90 | 126 | 20.14 | 126 |
| 23.41 | 128 | 22.23 | 128 | 20.53 | 128 |
| 23.65 | 130 | 22.57 | 130 | 20.93 | 130 |

Figure 8:
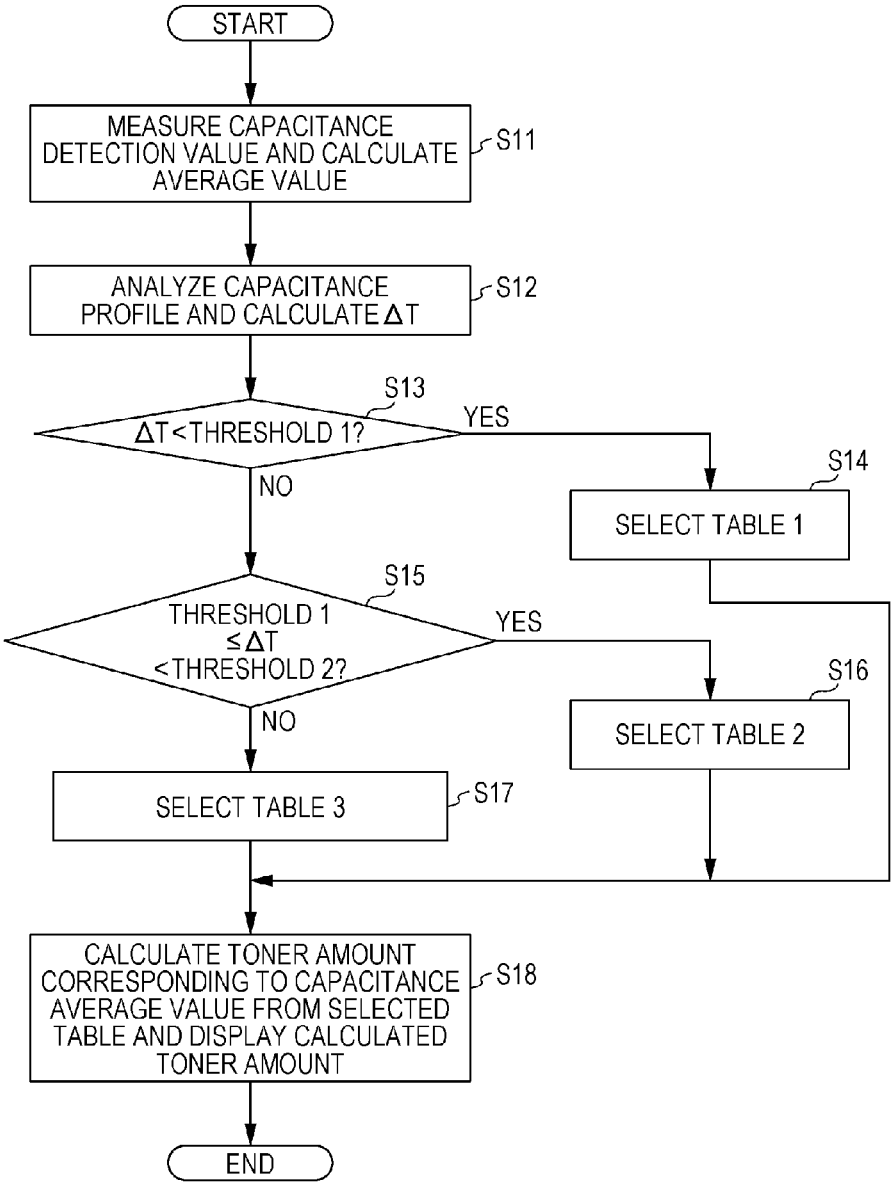
FIG. 8 is a flow chart showing a control process of a control portion.

FIG. 8 is a flow chart showing a control process of the control portion 18. The control portion 18 performs control such that current values are input into the capacitance detecting portion 15 from the electrode 42, the calculation portion 16 analog-digital converts the current values, measures capacitance detection values, and calculates a capacitance average value by averaging the capacitance detection values (S11).

The control portion 18 performs control such that the calculation portion 16 analyzes the profile of capacitance detection value and calculates the phase time difference ΔT of capacitance detection value (S12). Specifically, the phases of peaks are calculated from 300 capacitance detection values. The increase or decrease of each value is compared, and a point where the slope changes from negative to positive is determined as a peak position (local maximum value). The phases of peaks are calculated as described above, and the time difference between the phase corresponding to the agitating sheet 51*a* and the phase corresponding to the sealing sheet 51*b* is determined as ΔT.

If the measurement value varies due to external factors, averaging processing may be performed for each interval. For example, fine measurement may be performed to obtain, for example, 3000 capacitance detection values, the capacitance detection values may be averaged every ten values, and the increase or decrease in each interval in which averaging is performed may be analyzed. The control portion 18 compares the value of ΔT with a threshold provided beforehand.

The control portion 18 determines whether or not phase time difference ΔT<first threshold t1 (shown as threshold 1 in FIG. 8) (S13). If S13 is YES, the control portion 18 selects Table 1-1 provided beforehand (S14). If S13 is NO, the control portion 18 determines whether or not first threshold t1≤phase time difference ΔT<second threshold t2 (S15). The first threshold t1 is shown as threshold 1 in FIG. 8, and the second threshold t2 is shown as threshold 2 in FIG. 8.

If S15 is YES, the control portion 18 selects Table 1-2 provided beforehand (S16). If S15 is NO, the control portion 18 selects Table 1-3 provided beforehand (S17). In this way, the control portion 18 determines a table to be selected.

The control portion 18 calculates the toner amount corresponding to the capacitance average value from the selected table, and displays the calculated toner amount on the developer amount display device 19 (S18). By doing as above, highly accurate developer amount detection can be performed regardless of the deterioration of the sealing sheet 51*b*.

Thus, the control portion 18 performs control such that as the phase time difference between the local maximum value of the waveform of the agitating sheet 51*a* and the local maximum value of the waveform of the sealing sheet 51*b* detected by the capacitance detecting portion 15 increases, the amount of the developer in the storage chamber 4 with respect to this detected capacitance is estimated larger.

This embodiment is based on the premise that the rate of deterioration of the agitating sheet 51*a* differs from that of the sealing sheet 51*b*. In principle, whichever sheet deteriorates first, this sequence is possible.

While, in this embodiment, the initial phase difference between both sheets is 60°, there is no need to limit the invention to this value. When the initial phase difference is 0°, because of the same phase, the capacitance detection value has one peak, and as the sealing sheet 51*b* deteriorates, the peak divides.

Although, in this embodiment, attention is focused on the local maximum value, the shape of profile changes depending on the flowability of toner used, the shape of container, and the like. When a profile in which the change in local minimum value is significant with respect to the deterioration of the sealing sheet 51*b* is obtained, ΔT of local minimum value can also be used.

Second Embodiment

Figure 9:
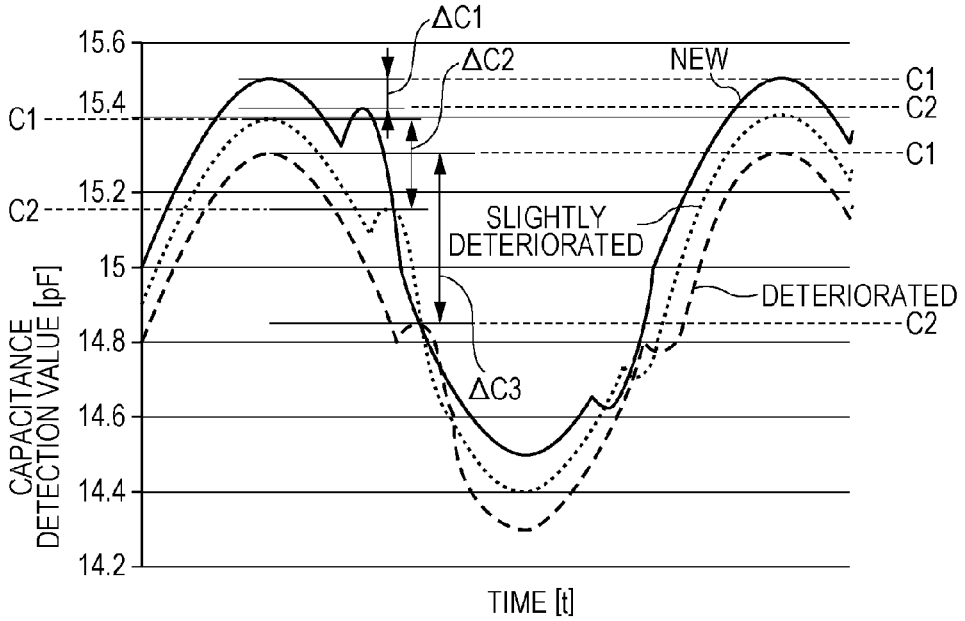
FIG. 9 shows graphs according to a second embodiment showing relationships between the capacitance detection value and the time in respective cases where the sealing sheet is new, slightly deteriorated, and deteriorated.

FIG. 9 shows graphs according to a second embodiment showing relationships between the capacitance detection value and the time in respective cases where the sealing sheet 51*b* is new, slightly deteriorated, and deteriorated. In the second embodiment, the calculation portion 16 of the controller 50 performs analyzes of capacitance detection value different from that of the first embodiment. As two peaks of a profile of capacitance detection value, local maximum value C1 of capacitance due to the agitating sheet 51*a* and local maximum value C2 of capacitance due to the sealing sheet 51*b* are measured, and the difference between the local maximum values of capacitance=local maximum value C1−local maximum value C2. The graphs of FIG. 9 are the same as the graphs of "New," "Slightly deteriorated," and "Deteriorated" of FIG. 7.

When the sealing sheet 51*b* is new, local maximum value C1 of capacitance (15.5 pF) and local maximum value C2 of capacitance (15.4 pF) in the part of local maximum value difference ΔC1 are referred to. The local maximum value difference ΔC1=C1−C2=0.1 pF.

When the sealing sheet 51*b* is slightly deteriorated, local maximum value C1 of capacitance (15.4 pF) and local maximum value C2 of capacitance (15.1 pF) in the part of local maximum value difference ΔC2 are referred to. The local maximum value difference ΔC2=C1−C2=0.3 pF.

When the sealing sheet 51*b* is deteriorated, local maximum value C1 of capacitance (15.3 pF) and local maximum value C2 of capacitance (14.8 pF) in the part of local maximum value difference ΔC3 are referred to. The local maximum value difference ΔC3=C1−C2=0.5 pF.

When respective ones of "New," "Slightly deteriorated," and "Deteriorated" are compared with each other, local maximum value C1 decreases with the deterioration, and local maximum value C2 decreases more significantly.

From the above, ΔC is large compared to before deterioration. When the sealing sheet 51*b* is further deteriorated, ΔC is much larger for the same reason. From the above, the state of deterioration of the sealing sheet 51*b* can be estimated by analyzing ΔC. In consideration of the above, a plurality of correspondence tables between the output average value and the toner amount corresponding to FIG. 6D are prepared (Table 1).

The degree of deterioration of the sealing sheet 51*b* is the degree to which the sealing sheet 51*b* is deteriorated, and corresponds to a degree that increases as the local maximum value difference ΔC in local maximum value of capacitance between the agitating sheet 51*a* and the sealing sheet 51*b* increases. As described above, it can be said that the degree of deterioration of the sealing sheet 51*b* when the sealing sheet 51*b* is new (local maximum value difference ΔC1) <when the sealing sheet 51*b* is slightly deteriorated (local maximum value difference ΔC2)<when the sealing sheet 51*b* is deteriorated (local maximum value difference ΔC3).

The controllers 50 perform the following on the basis of data on the output values of capacitance of a waveform having a rotation period of the agitating sheet 51*a* and the sealing sheet 51*b* as "respective ones of a plurality of sheet members" calculated by the calculation portion 16 (local maximum value difference between local maximum values of output values). The controller 50 (control portion 18) selects, on the basis of such a local maximum value difference, one of the pieces of information (one of Table 1-1, Table 1-2, and Table 1-3) correlated with one of such local maximum value differences (one of ΔC1, ΔC2, and ΔC3).

The controller 50 (control portion 18) selects one of the pieces of information (one of Table 1-1, Table 1-2, and Table 1-3) correlated with one of the local maximum value differences (one of ΔC1, ΔC2, and ΔC3) such that the larger the local maximum value difference, the larger the developer amount with respect to the output value of capacitance of the selected piece of information. As is obvious from Table 1, when the developer amount is 48 g, 15.01 pF in Table 1-1 of "New," 13.83 pF in Table 1-2 of "Slightly deteriorated," and 12.92 pF in Table 1-3 of "Deteriorated." This shows that as the developer amount with respect to the capacitance average value (output value of capacitance) increases, Table 1-1 is used, then Table 1-2 is used, and then Table 1-3 is used.

The calculation portion 16 of FIG. 3 is prepared to calculate local maximum value difference ΔC. In the case of this embodiment, a threshold when the sealing sheet 51*b* moves from a new state to a slightly deteriorated state in the graphs of FIG. 9 is referred to as a first threshold c1 and is set to 0.16 pF. This is a numerical value midway between local maximum value difference ΔC1 and local maximum value difference ΔC2. A threshold when the sealing sheet 51*b* moves from a slightly deteriorated state to a deteriorated state in the graphs of FIG. 9 is referred to as a second threshold c2 and is set to 0.34 pF. This is a numerical value midway between local maximum value difference ΔC2 and local maximum value difference ΔC3.

In FIG. 9, when the sealing sheet 51*b* is new, the average value of capacitance is 15 pF. Referring to Table 1-1 of Table 1, 48 g of developer exists in the storage chamber 4. This is the same as in the first embodiment. In FIG. 9, when the sealing sheet 51*b* is slightly deteriorated, the average value of capacitance is 14.90 pF. Referring to Table 1-2 of Table 1, 60 g of developer exists in the storage chamber 4. This is the same as in the first embodiment. In FIG. 9, when the sealing sheet 51*b* is deteriorated, the average value of capacitance is 14.80 pF. Referring to Table 1-3 of Table 1, 80 g of developer exists in the storage chamber 4. This is the same as in the first embodiment.

Figure 10:
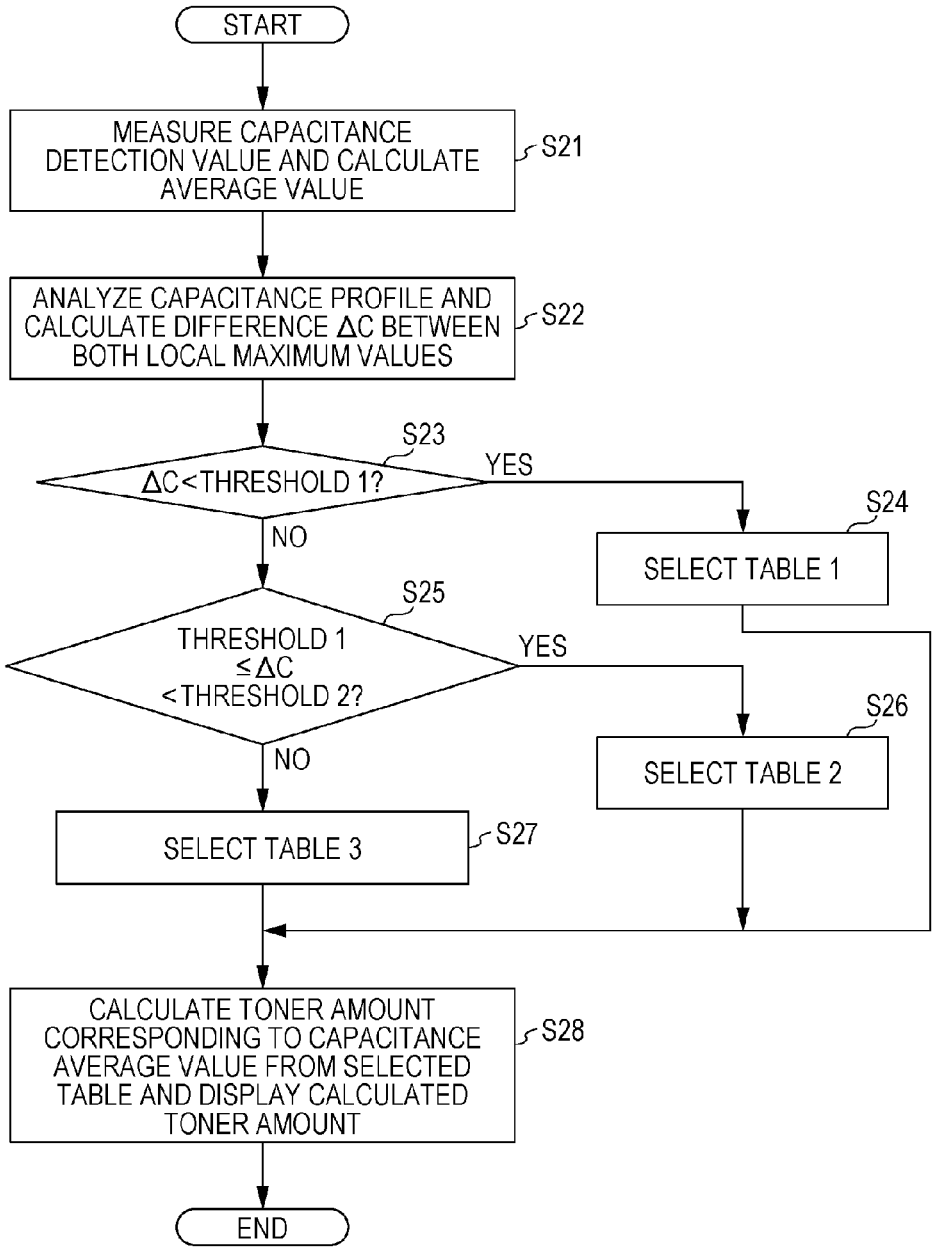
FIG. 10 is a flow chart showing a control process of the control portion.

FIG. 10 is a flow chart showing a control process of the control portion 18. The control portion 18 performs control such that current values are input into the capacitance detecting portion 15 from the electrode 42, the calculation portion 16 analog-digital converts the current values, measures capacitance detection values, and calculates a capacitance average value by averaging the capacitance detection values (S21).

The control portion 18 performs control such that the calculation portion 16 analyzes the profile of capacitance detection value and calculates the local maximum value difference ΔC of capacitance detection value (S22).

The control portion 18 determines whether or not ΔC<first threshold c1 (S23). If S23 is YES, the control portion 18 selects Table 1-1 provided beforehand (S24). If S23 is NO, the control portion 18 determines whether or not first threshold c1≤ΔC<second threshold c2 (S25). The first threshold c1 is shown as threshold 1 in FIG. 10, and the second threshold c2 is shown as threshold 2 in FIG. 10.

If S25 is YES, the control portion 18 selects Table 1-2 provided beforehand (S26). If S25 is NO, the control portion 18 selects Table 1-3 provided beforehand (S27). In this way, the control portion 18 determines a table to be selected.

The control portion 18 calculates the toner amount corresponding to the capacitance average value from the selected table, and displays the calculated toner amount on the developer amount display device 19 (S28). By doing as above, highly accurate developer amount detection can be performed regardless of the deterioration of the sealing sheet 51*b*.

Thus, the control portion 18 performs control such that as the local maximum value difference between the local maximum value of the waveform of the agitating sheet 51*a* and the local maximum value of the waveform of the sealing sheet 51*b* detected by the capacitance detecting portion 15 increases, the amount of the developer in the storage chamber 4 with respect to this detected capacitance is estimated larger.

Although, in this embodiment, attention is focused on the local maximum value, the shape of profile changes depending on the flowability of toner, the shape of container, and the like. When a profile in which the change in local minimum value is significant with respect to the deterioration of the sealing sheet 51*b* is obtained, local minimum value difference ΔC can also be used.

Third Embodiment

Figure 11A:
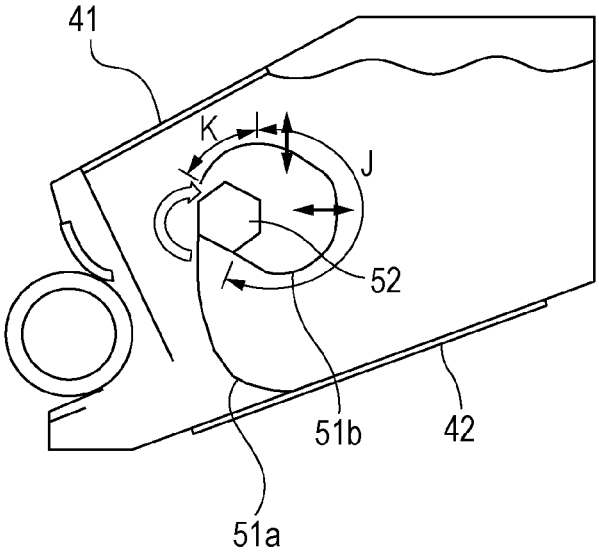
FIG. 11A is a sectional view of a cartridge.
Figure 11B:
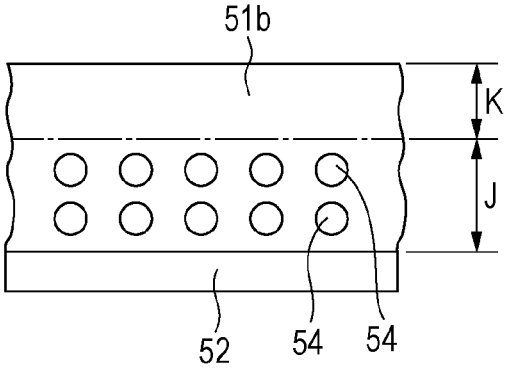
FIG. 11B is a plan view of a sealing sheet 51*b*, according to a third embodiment.

FIG. 11A is a sectional view of a cartridge B according to a third embodiment. FIG. 11B is a plan view of a sealing sheet 51*b*. The third embodiment differs from the above-described embodiments in that holes 54 are formed in the sealing sheet 51*b*. As described above, the reason that when the sealing sheet 51*b* is deteriorated, the output average value of capacitance is output small with respect to the toner amount is that the sealing sheet 51*b* wraps itself around the rotating shaft 52, toner is thereby less likely to enter the inside of the sealing sheet 51*b*, and the bulk density of toner decreases.

As shown in FIG. 11B, a plurality of holes 54 are formed in the sealing sheet 51*b*. The holes 54 are formed in a part (area J) other than the part sealing the opening of the storage chamber 4 such that developer can pass through them. The holes 54 as in FIG. 11B are formed in the range of area J of the sealing sheet 51*b* shown in FIG. 11A. The range of area J of the sealing sheet 51*b* is an area that has no effect on the initial toner sealing. Even when the holes 54 are formed therein, sealing of toner is possible. Toner can flow as shown by arrows in FIG. 11A. Area K is an area that seals the opening 20*a*.

In this configuration, if the size of the holes 54 is increased, the flow of toner increases, but the agitating force and conveying force decreases. So, by combining the formation of the holes 54 in the sealing sheet 51*b* with the correction of sequence, the difference in bulk density between the inside and outside of the sealing sheet 51*b* can be corrected while forming the holes 54 according to required agitating force and conveying force.

In the above-described embodiments, a plurality of tables are used as information on the relationship between the sealing sheet 51*b* and the output value of capacitance. Instead of this, a predetermined calculation formula (relational expression) may be used.

In the above-described embodiments, a case where the sealing sheet 51*b* is deteriorated as a sheet member has been described. However, the present invention can also be applied to a case where a plurality of agitating sheets 51*a* as sheet members exist.

According to the present invention, even if a sheet member is deteriorated, the detection accuracy of the developer amount improves.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-228935, filed Nov. 11, 2014, which is hereby incorporated by reference herein in its entirety.

What is claimed is:

1. An image forming apparatus comprising:

a storage chamber configured to store developer;

a plurality of sheet members disposed between a first electrode and a second electrode and rotatably disposed in the storage chamber;

a detecting portion configured to detect a periodically fluctuated output value relating to capacitance between the first electrode and the second electrode; and a controller configured to determine an amount of the developer based on a phase time difference between a highest local maximum value of the periodically fluctuated output value and an another local maximum value that comes next to the highest local maximum value in one period, occurring due to respective ones of the plurality of sheet members.

2. The image forming apparatus according to claim 1, wherein the plurality of sheet members includes a sealing member configured to prevent the developer from leaking through an opening of the storage chamber or an agitating member configured to agitate the developer.

3. The image forming apparatus according to claim 2, wherein the sealing member is lower in stiffness than the agitating member.

4. The image forming apparatus according to claim 3, wherein the sealing member has holes that are formed in a part of the sealing member other than the part sealing the opening of the storage chamber and through which the developer can pass.

5. The image forming apparatus according to claim 1, wherein, the controller includes:

(I) a first table which maintains a first relationship between the periodically fluctuated output value and the amount of developer, and which corresponds to a case that the phase time difference is a first value, and (II) a second table which maintains a second relationship that is different from the first relationship and is between the periodically fluctuated output value and the amount of developer, and which corresponds to a case that the phase time difference is a second value greater than the first value, wherein, to determine the amount of the developer, the controller selects one table from the first table and the second table based on the phase time difference.

6. The image forming apparatus according to claim 5, wherein the controller selects one table correlated with the phase time difference such that the larger the phase time difference, the larger the developer amount with respect to the periodically fluctuated output value of the selected table.

7. The image forming apparatus according to claim 1, wherein the plurality of sheet members are sheets attached to a rotating shaft rotating in the storage chamber, and the detecting portion detects that, when any one of the plurality of sheet members wraps itself around the rotating shaft, the periodically fluctuated output value changes.

8. An image forming apparatus comprising:

a storage chamber configured to store developer;

a plurality of sheet members disposed between a first electrode and a second electrode and rotatably disposed in the storage chamber;

a detecting portion configured to detect a periodically fluctuated output value relating to capacitance between the first electrode and the second electrode; and a controller configured to determine an amount of the developer based on a local maximum value difference between a highest local maximum value of the periodically fluctuated output value and an another local maximum value that comes next to the highest local maximum value in one period, occurring due to respective ones of the plurality of sheet members.

9. The image forming apparatus according to claim 8, wherein, the controller includes:

(I) a first table which maintains a first relationship between the periodically fluctuated output value and the amount of developer, and which corresponds to a case that the local maximum value difference is a first value, and (II) a second table which maintains a second relationship that is different from the first relationship and is between the periodically fluctuated output value and the amount of developer, and which corresponds to a case that the local maximum value difference is a second value greater than the first value, wherein, to determine the amount of the developer, the controller selects one table from the first table and the second table based on the local maximum value difference.

10. The image forming apparatus according to claim 9, wherein the controller selects one table correlated with the local maximum value difference such that the larger the local maximum value difference, the larger the developer amount with respect to the periodically fluctuated output value of the selected table.

11. An image forming apparatus comprising:

a storage chamber configured to store developer;

a plurality of sheet members disposed between a first electrode and a second electrode and rotatably disposed in the storage chamber;

a detecting portion configured to detect a periodically fluctuated output value relating to capacitance between the first electrode and the second electrode; and a controller configured to determine an amount of the developer based on a phase time difference between a lowest local minimum value of the periodically fluctuated output value and an another local minimum value that comes next to the lowest local minimum value in one period, occurring due to respective ones of the plurality of sheet members.

12. The image forming apparatus according to claim 11, wherein, the controller includes:

(I) a first table which maintains a first relationship between the periodically fluctuated output value and the amount of developer, and which corresponds to a case that the phase time difference is a first value, and (II) a second table which maintains a second relationship that is different from the first relationship and is between the periodically fluctuated output value and the amount of developer, and which corresponds to a case that the phase time difference is a second value greater than the first value, wherein, to determine the amount of the developer, the controller selects one table from the first table and the second table based on the phase time difference.

13. The image forming apparatus according to claim 12, wherein the controller selects one table correlated with the phase time difference such that the larger the phase time difference, the larger the developer amount with respect to the periodically fluctuated output value of the selected table.

14. An image forming apparatus comprising:

a storage chamber configured to store developer;

a plurality of sheet members disposed between a first electrode and a second electrode and rotatably disposed in the storage chamber;

a detecting portion configured to detect a periodically fluctuated output value relating to capacitance between the first electrode and the second electrode; and a controller configured to determine an amount of the developer based on a local minimum value difference between a lowest local minimum value of the periodically fluctuated output value and an another local minimum value that comes next to the lowest local minimum value in one period, occurring due to respective ones of the plurality of sheet members.

15. The image forming apparatus according to claim 14, wherein, the controller includes:

(I) a first table which maintains a first relationship between the periodically fluctuated output value and the amount of developer, and which corresponds to a case that the local minimum value difference is a first value, and (II) a second table which maintains a second relationship that is different from the first relationship and is between the periodically fluctuated output value and the amount of developer, and which corresponds to a case that the local minimum value difference is a second value greater than the first value, wherein, to determine the amount of the developer, the controller selects one table from the first table and the second table based on the local minimum value difference.

16. The image forming apparatus according to claim 15, wherein the controller selects one table correlated with the local minimum value difference such that the larger the local minimum value difference, the larger the developer amount with respect to the periodically fluctuated output value of the selected table.

* * * * *